US007038587B2

(12) United States Patent
Bellum et al.

(10) Patent No.: US 7,038,587 B2
(45) Date of Patent: May 2, 2006

(54) IDENTIFICATION DEVICE FOR MULTILAYER TUBULAR STRUCTURES

(75) Inventors: Cliff Bellum, Hartsville, SC (US); James Lowry, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 87 days.

(21) Appl. No.: 10/818,379

(22) Filed: Apr. 5, 2004

(65) Prior Publication Data

US 2005/0237200 A1 Oct. 27, 2005

(51) Int. Cl.
*G08B 13/14* (2006.01)

(52) U.S. Cl. ..... 340/572.8; 340/572.7; 340/572.1

(58) Field of Classification Search ..... 340/572.8, 340/572.7, 572.1, 572.4, 568.1, 571; 700/215, 700/225, 226, 227; 235/492, 488; 348/64, 348/106

See application file for complete search history.

(56) References Cited

U.S. PATENT DOCUMENTS

| | | | | |
|---|---|---|---|---|
| 5,785,181 A | | 7/1998 | Quartararo, Jr. | |
| 5,963,134 A | | 10/1999 | Bowers et al. | |
| 6,040,773 A | | 3/2000 | Vega et al. | |
| 6,104,295 A | | 8/2000 | Gaisser et al. | |
| 6,140,146 A | * | 10/2000 | Brady et al. | 438/62 |
| 6,222,452 B1 | * | 4/2001 | Ahlstrom et al. | 340/572.1 |
| 6,252,508 B1 | | 6/2001 | Vega et al. | |
| 6,334,587 B1 | | 1/2002 | Röder | |
| 6,481,631 B1 | | 11/2002 | Poustis | |
| 2004/0102869 A1 | * | 5/2004 | Andersen et al. | 700/215 |
| 2004/0102870 A1 | * | 5/2004 | Andersen et al. | 700/215 |

FOREIGN PATENT DOCUMENTS

| | | |
|---|---|---|
| DE | 202 05 555 U1 | 7/2002 |
| DE | 203 05 299 U1 | 10/2003 |
| EP | 1 236 650 A1 | 9/2002 |
| EP | 1 369 353 A2 | 12/2003 |
| WO | WO 99/05660 | 2/1999 |
| WO | WO 99/46744 | 9/1999 |
| WO | WO 01/18732 A2 | 3/2001 |

OTHER PUBLICATIONS

Copy of Partial International Search Report for PCT Application No. PCT/US2005/011339.

* cited by examiner

*Primary Examiner*—Toan N. Pham
(74) *Attorney, Agent, or Firm*—Alston & Bird LLP

(57) ABSTRACT

A multilayer tubular structure for products with an identification device being embedded or interposed between two of the multiple layers of the tubular structure. The identification device is responsive to radio frequencies and is able to store and transmit information about the multilayer tubular structure, the products, and processes that have been performed on same. A method is provided for manufacturing a multilayer tubular structure by embedding a radio frequency identification device between two of the multiple layers.

28 Claims, 4 Drawing Sheets

IDENTIFICATION DEVICE FOR MULTILAYER TUBULAR STRUCTURES

BACKGROUND OF THE INVENTION

The present invention relates to "smart packaging" systems and methods, and more particularly to electronic detection devices, such as radio frequency identification devices ("RFID" tags or devices hereinafter) and methods of using these devices in packaging and package tracking systems.

Monitoring the location and status of items is advantageous in many applications. For example, in manufacturing environments it is important to know the whereabouts of items in a factory, and in transportation environments it is important to identify and document the coming and going of items from a warehouse or the like. Bar codes have traditionally been used to identify and track items. In particular, 1D bar codes are most common and are used to identify items at the grocery store, etc. More recently, 2D bar codes have been developed and provide substantially more information than 1D bar codes. Thus, 2D bar codes are used with shipping labels and other items where more information is typically needed to identify the item(s) associated with the bar code. However, 1D and 2D bar code systems are often not compatible with one another, and the bar code must be clearly visible and readable by a scanner or the like in order to transfer the information associated with the bar code.

Another method for tracking an item and/or transferring information about an item is through a magnetic strip having pre-programmed coded information that is attached to an outer surface of an item. The information is read by passing the magnetic strip through a high-resolution magnetic reader to produce an electric field. While this technology does not require a clear line-of-sight between the reader and the strip for proper reading of the information, the distance at which the strip can be read is limited, and the system is limited to read-only. The magnetic strips are also prone to damage, which can be a problem for longer magnetic strips that contain more data.

Another way to track items is through the use of RFID. RFID has been used for some time in a variety of applications, from tracking garments to pallets to trucks. RFID works on an inductive principle. In a passive RFID system, a reader generates a magnetic field at a predetermined frequency. When a RFID tag, which can be usually categorized as being read-only or read/write, enters the magnetic field, a small electric current forms in the tag's resonant circuit, which includes a coiled antenna and a capacitor. This circuit provides power to the RFID tag, which then modulates the magnetic field in order to transmit information that is pre-programmed on the tag back to the reader at a predetermined frequency, such as 125 kHz (low frequency) or 13.56 MHz (high frequency). The reader then receives, demodulates, and decodes the signal transmission, and then sends the data onto a host computer associated with the system for further processing.

An active RFID system operates in much the same way, but in an active system the RFID tag includes its own battery, allowing the tag to transmit data and information at the touch of a button. For example, a remote control garage door opener typically uses an active RFID tag that transmits a predetermined code to the receiver in order to raise and lower the garage door at the user's discretion.

Another technology that is related to RFID tags is known as Bistatix, which operates much the same way as RFID tags except that the coiled antenna and capacitor of the RFID tags have been replaced by a printed, carbon-based material. As a result, a Bistatix tag is extremely flat and relatively flexible, although currently these types of devices are limited to a frequency range of about 125 KHz. In addition, the read range of a Bistatix tag is dependent on size, so for long read ranges a very large tag may be required. Regardless, whether a Bistatix, active, or passive RFID tag is used in a particular tracking system, these tags and systems have greatly advanced package tracking and data management.

One of the challenges that exist with electronic detection devices, and with RFID systems in particular, is how to apply a RFID tag to an item. Currently tags are glued to an outer surface of a container or pallet, and while this method is satisfactory for many applications, the prominent location of the tag often leaves the tag exposed and subject to damage or inadvertent removal during processing. Other types of tag applications include sewing tags into a garment and clipping tags to an item with metal fasteners. The difficulties in applying a detection device is particularly pronounced when applying such devices or tags to tubular rolls or containers, such as those used in supporting roll goods or for packaging food products, as these types of structures often rub against one another during production and thereby cause damage to the tags. In addition, reusable carriers or containers are often used for many cycles, such as in doffing and creeling textile yarn, which can further accelerate damage to the RFID tag. Thus, there is a need to manufacture a container or carrier having an electronic detection device that will not be damaged or destroyed during processing.

BRIEF SUMMARY OF THE INVENTION

These and other needs are provided by the multilayer tubular structure and methods of forming the multilayer tubular structure according to the present invention. Advantageously, the multilayer tubular structure of the present invention includes a tubular body having an electronic detection device, such as a radio frequency identification device or tag, which is embedded therein. As such, the detection device of the present invention cannot be damaged or broken during processing or use of the multilayer tubular structure. Because the device is hidden inside the multilayer tubular body, the device is less likely to be seen and possibly removed, which is useful from a security standpoint.

More particularly, a multilayer tubular structure according to one embodiment of the present invention comprises a tubular body formed from multiple plies or layers of flexible material, such as paperboard, wrapped one upon another about an axis of the tubular body and adhered together in a radially layered construction. Such tubular bodies are used as containers for packaging products, such as cookies and potato crisps, and as winding cores for supporting products wound around the outer surface of the tube, such as textiles, paper goods, and the like. The term "multilayer tubular structure" is used herein to denote both containers and winding cores, noting that the advantageous features of the present invention may exist in each type of tubular body.

The multilayer tubular structure also includes a radio frequency identification (RFID) device that is interposed between two of the multiple layers of the tubular body. The identification device is capable of storing and transmitting data associated with the multilayer tubular structure, the products stored in or on the multilayer tubular structure, or both. In addition, other data can be stored, transmitted to and from, and deleted from the identification device.

The identification device can have many shapes and configurations, but according to one embodiment the device is relatively thin and flat, and includes a coiled antenna and a capacitor that respond to magnetic fields, such as presented by radio frequency transmitters. The identification device is spaced a predetermined distance from the opposed ends of the tubular body, and in one embodiment is laminated to at least one of the multiple layers of the tubular body.

In another embodiment, at least one of the multiple layers of the tubular body defines an opening sized to fit the identification device such that the identification device can substantially occupy the opening of the layer.

In yet another embodiment, the identification device is comprised of a matrix of distinct metallic particles within at least a portion of the tubular body. In particular, the metallic particles can be mixed with the fibers, such as paper fibers, comprising the flexible material so that the identification device is integrally bonded to the tubular body. While the identification device is comprised of a plurality of individual particles, the particles act together to perform similarly to identification devices having coiled antennas and capacitors. The metallic particles may be localized in a particular area of the tubular body or dispersed substantially throughout the tubular body. In either case, the identification device cannot be readily removed from the multilayer tubular structure because it is formed as part of the tubular body. However, information regarding the multilayer tubular structure, the products, or any other information can be deleted, overwritten, substituted, and/or transferred from the identification device.

Methods of manufacturing and using multilayer tubular structures also form part of the present invention. According to one method, a multilayer tubular structure for storing products is manufactured by wrapping multiple layers of flexible material about a mandrel into a tubular body, and embedding an identification device in the tubular body during the wrapping step such that the identification device is interposed between two of the multiple layers of the tubular body. According to one method, the identification device is laminated to at least one of the multiple layers, and in another method an opening is formed in at least one of the layers such that the identification device substantially occupies the opening during the wrapping step. Advantageously, the opening defined by the layer or layers accommodates the thickness of the identification device so that the identification device does not create a bulge or raised section in the tubular body.

The multilayer tubular structure of the present invention has many uses. Because the identification device is embedded in the tubular body, the device is safe from damage or breakage from being hit or bumped during processing, and cannot be easily lost, removed, or stolen. The multilayer tubular structure is particularly useful for tracking products that are stored on or therein, such as cookies, potato crisps, roll goods, and the like. The methods of the present invention do not require special construction techniques, end caps, or special grooves cut into portions of the tubular structure, which increase manufacturing efficiency and reduce cost.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
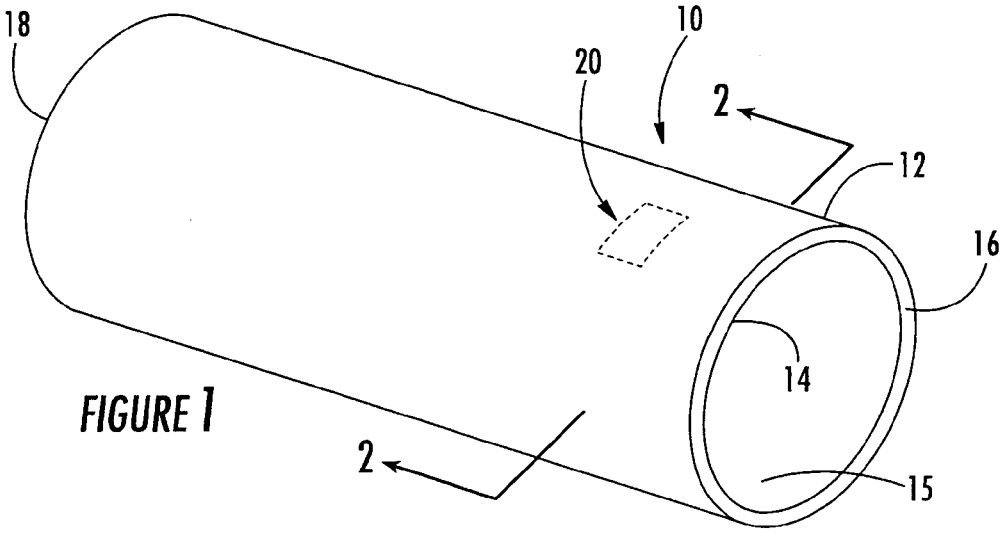
FIG. 1 is a side perspective view of a multilayer tubular structure according to one embodiment of the present invention.
Figure 2:
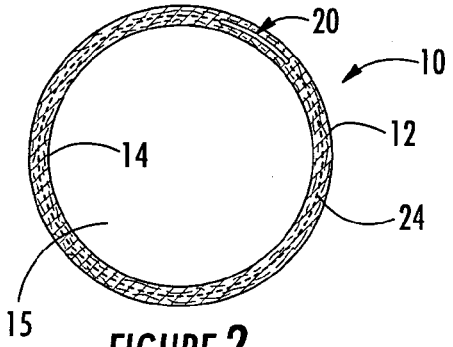
FIG. 2 is an end elevation view of the multilayer tubular structure shown in FIG. 1.

Turning to the figures, FIGS. 1 and 2 illustrate a multilayer tubular structure according to the present invention. In particular, reference number 10 refers to a multilayer tubular structure used for packaging products and the like, or to a winding core or tube such as is used to support roll goods, such as textiles, paper, plastic, and other materials.

The multilayer tubular structure 10 includes multiple layers or plies of one or more known flexible materials that are strong and particularly advantageous for packaging products and supporting roll goods. In particular, the multilayer tubular structure 10 includes an outer layer 12 and an inner layer 14 that form a tubular shape defining a central opening 15 and opposed ends 16, 18. While not shown, other common layers of a multilayer tubular structure may also be present, such as a liner ply and/or a label ply. One or more end closures or overcaps (not shown) may also be present as dictated by the use of the multilayer tubular structure. The various plies or layers can comprise any number of materials, including but not limited to paperboard, plastic, metal foil, metallized plastic, or combinations thereof.

Figure 3A:
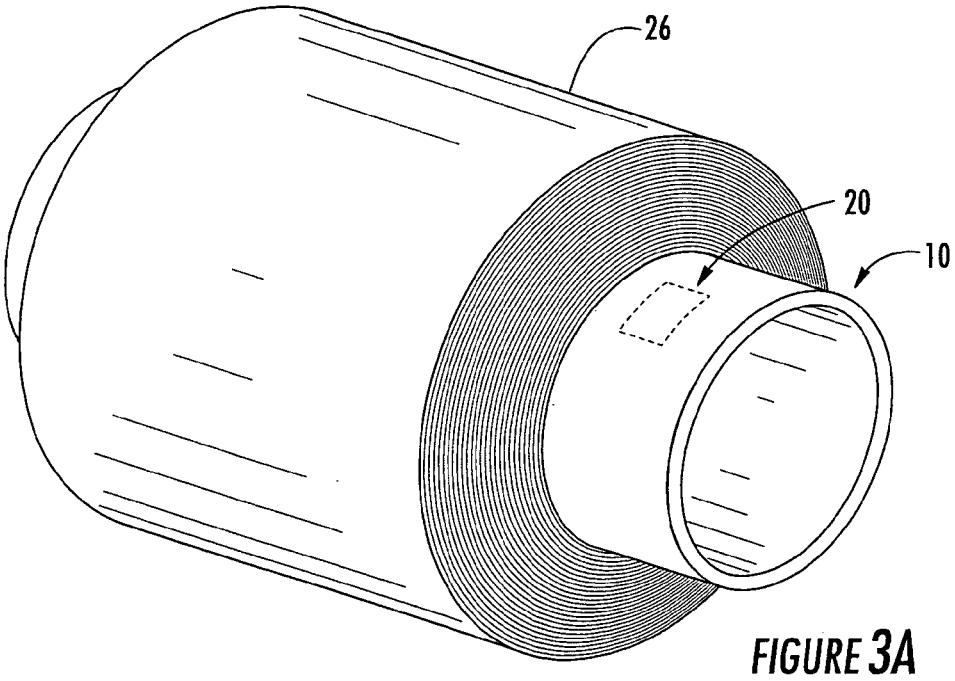
FIG. 3A is a perspective view of a multilayer tubular structure having roll goods wound thereupon according to one embodiment of the present invention.
Figure 3B:
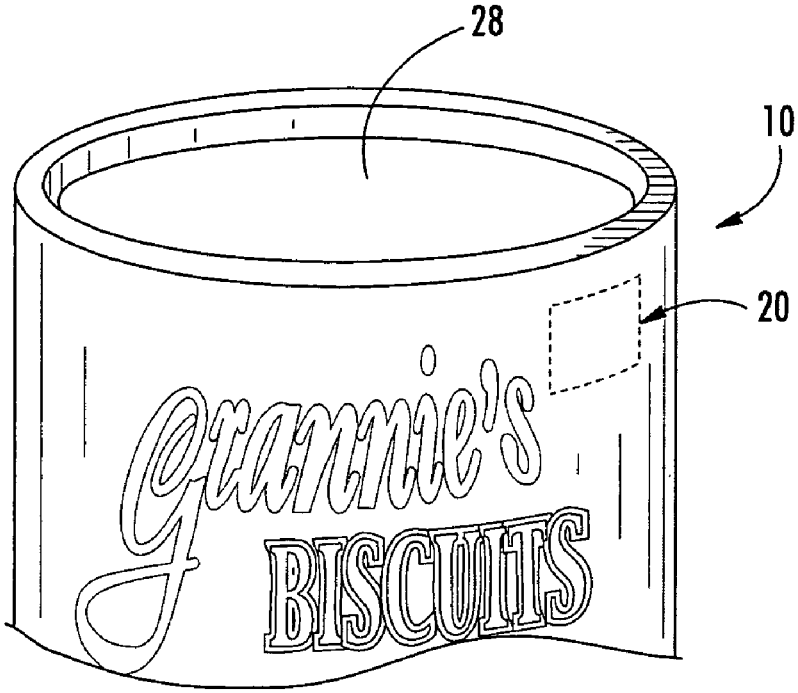
FIG. 3B is a perspective view of a multilayer tubular structure having products disposed therein according to one embodiment of the present invention.
Figure 4:
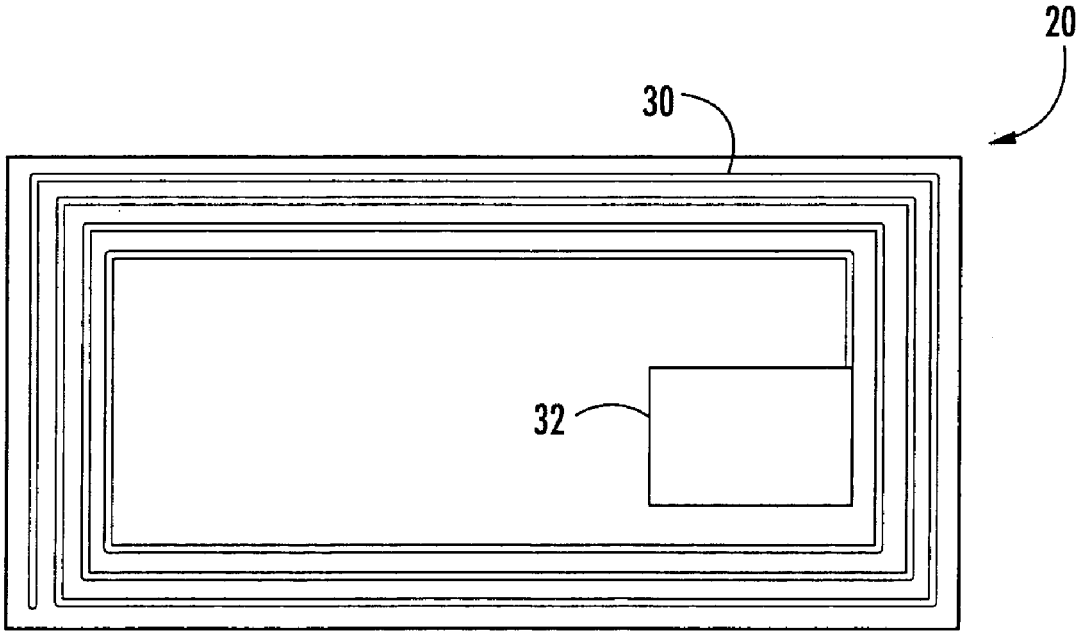
FIG. 4 is a top elevation view of an identification device according to one embodiment of the present invention.

As shown in phantom lines in FIGS. 1 and 3 and in detail in FIG. 4, the multilayer tubular structure 10 also includes an identification device 20. The identification device 20 can have different forms and be comprised of various materials, but according to one embodiment the identification device is responsive to radio frequencies and comprises a coiled antenna 30 and a capacitor or processor 32. Such radio frequency identification ("RFID") devices or tags are known and are available from a variety of manufacturers, such as Motorola® and Texas Instruments®. The coiled antenna 30 is typically made from metal, although printed carbon-based materials, such as those described herein, may also be used.

As shown in FIG. 2, the identification device 20 is positioned between the outer layer 12 and inner layer 14 of the tubular body 10. Many layers or plies may be present in the tubular body 10, but the number of layers described herein is limited for simplicity. As described below, the identification device 20 is embedded into the tubular body during manufacture, which helps prevent damage to the device and helps keep the device hidden.

The device 20 is able to store information about the multilayer tubular structure 10, products associated with the multilayer tubular structure, and information regarding the processing or actions taken with respect thereto. For example, FIG. 3A shows a tubular structure 10 having roll goods 26, such as plastic sheeting, being wound thereupon. Similarly, FIG. 3B shows a tubular structure 10 having products 28 stored therein, such as cookies, biscuits, potato crisps, or non-food products. The device 20 is capable of storing a unique ID for the multilayer tubular structure 10, the goods 26, or processes performed on the tubular structure or goods, such as moving the structure and goods with a transporter or processing the goods in a downstream operation. Other information, such as product ID, technical data, quality control information, code dating, location, and order status may be imported, stored, and transmitted by the device 20. Information can also be deleted, which includes overwriting, erasing, substituting, and disabling, so that the tubular structure 10 can be re-used for additional products or goods. These types of features allow for improved inventory management, inventory control, in-house product location, and supply chain management.

Figure 5A:
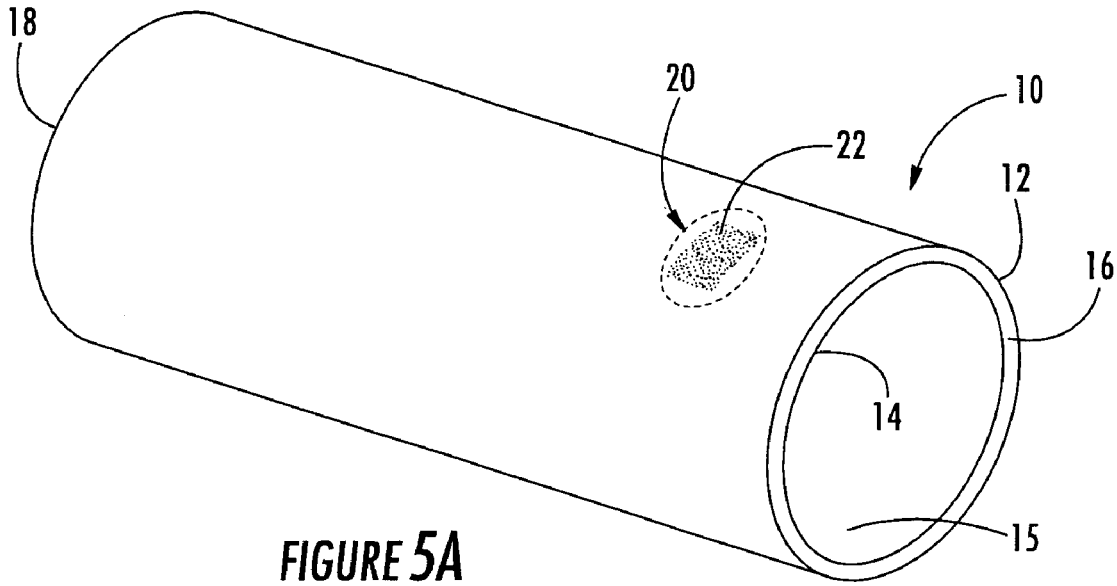
FIG. 5A is a perspective view of a multilayer tubular structure having a localized matrix of particles embedded therein according to one embodiment of the present invention.
Figure 5B:
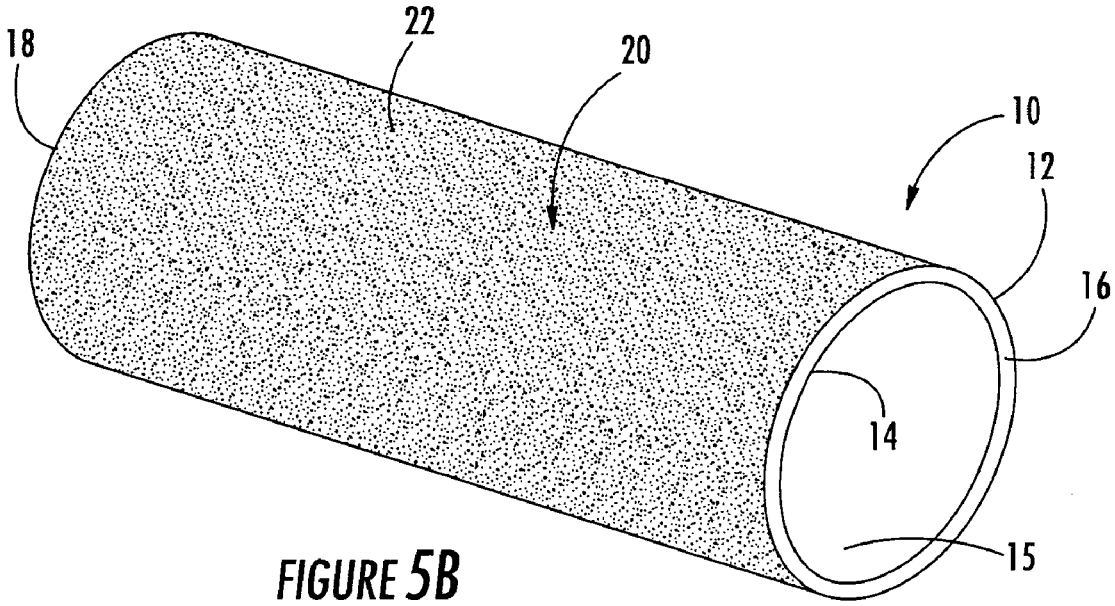
FIG. 5B is a perspective view of a multilayer tubular structure having a substantially dispersed matrix of particles embedded therein according to one embodiment of the present invention.

FIGS. 5A and 5B represent an alternative embodiment to the multilayer tubular structure 10 of the present invention, whereby the device 20 is in the form of a matrix of distinct metallic flakes or particles 22, such as ferrous slivers, that are embedded within a least a portion of the tubular structure. The particles 22 forming the device 20 in this embodiment respond in the same manner as the devices described above, such that information can be stored and transmitted about the multilayer tubular structure, the products, or processes performed thereon. Preferably, the particles 22 are mixed or integrally bonded with the fibers, such as paper fibers, forming at least one of the layers of the tubular body, and may be either concentrated in a particular or discrete location of the tubular body, or may be dispersed substantially throughout the tubular body as described below.

Figure 6:
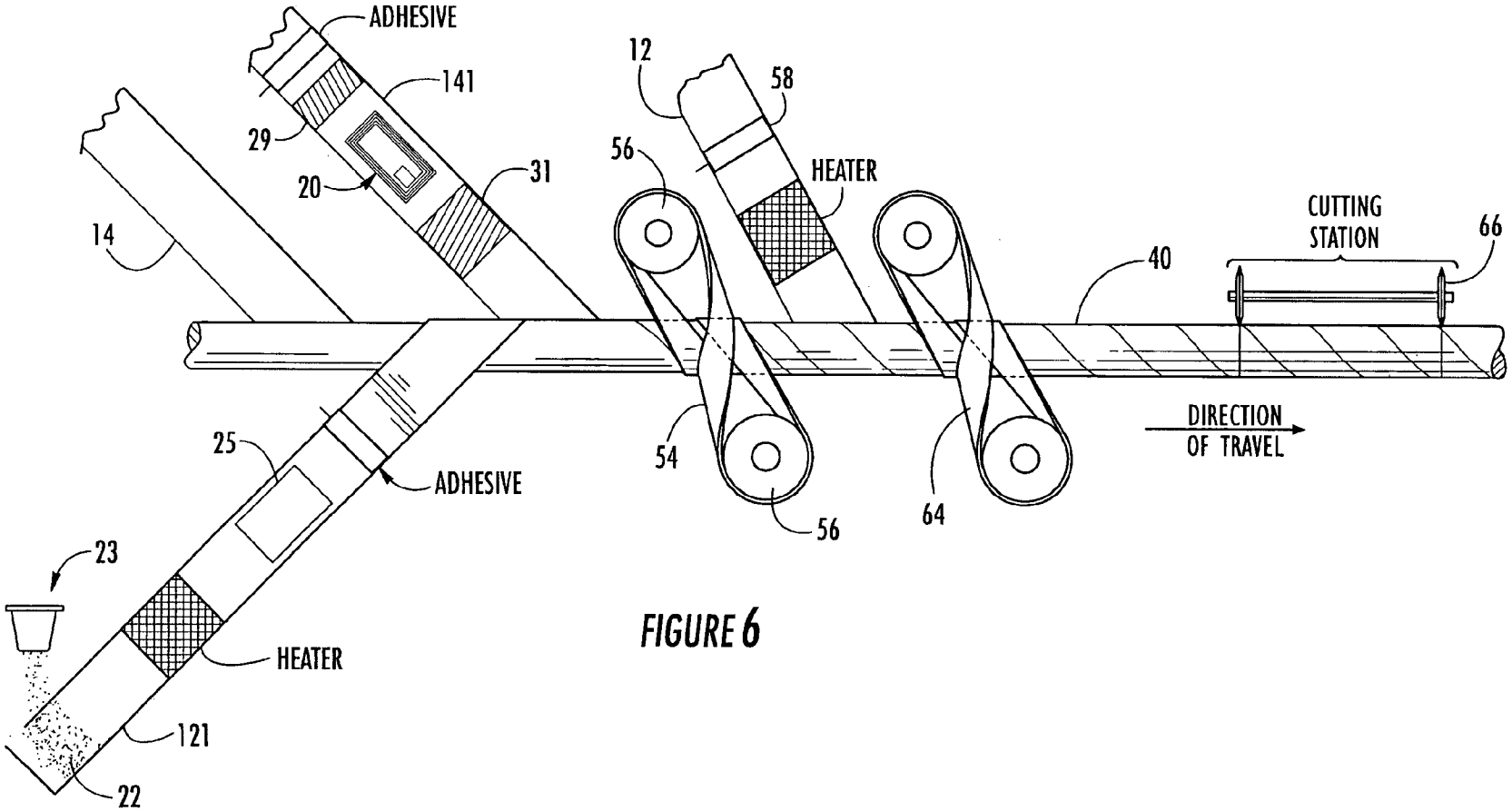
FIG. 6 is a plan view illustrating a method for making a multilayer tubular structure according to one embodiment of the present invention.

FIG. 6 illustrates a method for making a composite multilayer tubular structure according to the present invention. A continuous strip of flexible body ply material 121 is first advanced toward a shaping mandrel 40. The body ply material 121 in FIG. 6 is an internal layer disposed between the outer layer 12 and the inner layer 14. More internal layers may be present; however, in one embodiment no internal layers are present, leaving only the inner and outer layers to comprise the tubular body. In one alternative embodiment also shown in FIG. 6, body ply material 121 may be presented with a plurality of metallic particles 22 dispersed at predetermined intervals or continuously by a feeder 23. The body ply material 121 is preferably a loose form of wet paper fibers when the particles 22 are dispersed or applied thereto such that the particles and the paper fibers are integrally bonded to one another, although it is possible to apply the particles to only the surface of the relatively wet or dry body ply material 121. In one embodiment, the body ply material 121 defines an opening 25 that is sized to fit the identification device 20. The body ply material 121 may also pass under adhesive rollers and heaters depending on the application.

The inner layer 14 is also advanced toward the mandrel 40 as well a support layer 141, which according to one embodiment has an identification device 20 applied thereto by an applicator 29. A heated nip 31 may also be present to laminate the identification device 20 to the support layer 141. Although not described in detail for clarity, various liner and barrier material configurations could be employed at this general stage of manufacture depending upon the products or goods used in conjunction with the multilayer tubular structure 10.

The inner layer 14, body ply material 121, and support layer 141 are advanced toward the mandrel 40 and helically wrapped around the mandrel one atop another to form a multilayer tubular structure. In one embodiment, the opening 25 defined by the body ply material 121 is advanced around the mandrel 40 so that the identification device 20 substantially occupies the opening. Advantageously, the thickness of the identification device 20 is accommodated by the opening 25 and the thickness of the body ply material 121 such that the finished multilayer tubular structure 10, and particularly the inner and outer layers 14, 12, do not show or indicate the presence of the identification device, such as with a rise, bump, or other visible sign.

The tubular structure is advanced down the mandrel 40 by a conventional winding belt 54 that extends around a pair of opposed pulleys 56. The winding belt 54 not only rotates and advances the tubular structure, but also applies pressure to the individual layers or plies to ensure a secure bond therebetween.

Downstream of the winding belt 54, a continuous outer layer 12 is advanced toward the mandrel 40 through an adhesive applicator 58 that applies an adhesive to the inner surface of the outer layer. The outer layer 12 and the adhesive applied thereto are then passed underneath a heater to render the adhesive substantially tacky.

After passing underneath the heater, the outer layer 12 is then wrapped around the mandrel 40 onto the advancing tubular structure. It should be noted that as each ply or layer is wound about the mandrel 40, a trailing edge of the ply is brought into contact with a leading edge of the ensuing portion of the ply, the edges becoming abutted together to form a butt joint therebetween. It should also be noted that while spiral or helical winding is discussed herein, the multilayer tubular structures 10 of the present invention could be formed by convolute winding or the like.

The wrapped layers or plies are then advanced down the mandrel 40 by a winding belt 64. The winding belt 64 rotates and advances the wrapped layers and applies pressure to the overlapping edges of the layers to ensure a secure bond between the respective edges. After the multiple layers have been secured together on the mandrel to form a continuous tubular structure, the tubular structure is scored or cut by a cutting station 66. The cutting is preferably performed at regular intervals such that the identification device (if applicable) is near one of the resulting ends 16, 18, but spaced inwardly therefrom. After the tubular structure 10 is cut, it is removed from the mandrel 40.

Accordingly, the multilayer tubular structure and method of the present invention overcome limitations and deficiencies presented by conventional containers and cores and methods of manufacturing such containers and cores. In particular, the multilayer tubular structure and methods for manufacturing same of the present invention provide a multilayer tubular structure that includes an identification device that is less susceptible to damage or theft, and the structure can be formed by incorporating conventional manufacturing techniques and systems. The multilayer tubular structure and methods of the present invention will therefore not only result in decreased production costs, but will reduce inefficiencies in supply chain management, inventory management, inventory control, and in-house product location.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A multilayer tubular structure for storing products, comprising:

a tubular body formed from multiple layers of flexible material wrapped one upon another about an axis of the tubular body and adhered together, the tubular body having inner and outer surfaces and opposed ends; and a radio frequency identification device interposed between two of the multiple layers of the tubular body, the radio frequency identification device being spaced a predetermined distance from the opposed ends of the tubular body.

2. A multilayer tubular structure according to claim 1, wherein the identification device is laminated to at least one of the multiple layers of the tubular body.

3. A multilayer tubular structure according to claim 1, wherein at least one of the multiple layers of the tubular body defines an opening sized to fit the identification device such that the identification device can substantially occupy the opening of the at least one of the multiple layers.

4. A multilayer tubular structure according to claim 1, wherein the identification device is capable of storing and transmitting data associated with at least one of the tubular structure and the products.

5. A multilayer tubular structure according to claim 1, wherein the identification device includes a coiled antenna and a capacitor.

6. A multilayer tubular structure according to claim 1, wherein the identification device includes a printed carbon-based antenna.

7. A multilayer tubular structure according to claim 1, wherein a plurality of the multiple layers are at least partially formed from paperboard.

8. A multilayer tubular structure for storing products, comprising:

a tubular body formed from multiple layers of flexible material wrapped one upon the other about an axis of the tubular body and adhered together, the tubular body having inner and outer surfaces and opposed ends; and a radio frequency identification device capable of storing and transmitting data associated with at least one of the multilayer tubular structure and the products, the identification device being comprised of a matrix of distinct metallic particles that are embedded within a least a portion of the tubular body, whereby the tubular body and the distinct particles are integrally bonded to one another.

9. A multilayer tubular structure according to claim 8, whereby the particles are dispersed substantially throughout the tubular body.

10. A multilayer tubular structure according to claim 8, wherein a plurality of the multiple layers are at least partially formed of paperboard.

11. A method of manufacturing a multilayer tubular structure for storing products, the method comprising:

wrapping multiple layers of flexible material about a mandrel into a tubular body, the tubular body having inner and outer surfaces and opposed ends; and embedding a radio frequency identification device having an antenna and a capacitor in the tubular body during the wrapping of the flexible material about the mandrel such that the identification device is interposed between two of the multiple layers of the flexible material and between the inner and outer surfaces of the tubular body, and spaced away from the opposed ends thereof.

12. A method according to claim 11, further comprising laminating the identification device to at least one of the multiple layers of flexible material.

13. A method according to claim 11, further comprising storing information about at least one of the multilayer tubular structure and the products in the identification device.

14. A method according to claim 13, further comprising identifying the information about at least one of the multilayer tubular structure and the products stored in the identification device using a reading device.

15. A method according to claim 11, further comprising forming an opening in at least one of the multiple layers such that the identification device substantially occupies the opening during the wrapping step.

16. A method of manufacturing a multilayer tubular structure for storing products, the method comprising:

forming a plurality of fibers into elongate sheets of flexible material;

wrapping multiple plies of the flexible material about a mandrel into a tubular body, the tubular body having inner and outer surfaces and opposed ends; and embedding a radio frequency identification device in the tubular body by mixing the identification device with the fibers during the flexible material forming step.

17. A method according to claim 16, wherein the forming step includes forming a plurality of paper fibers into elongate sheets of flexible paperboard material.

18. A method according to claim 16, further comprising storing information about at least one of the multilayer tubular structure and the products in the identification device.

19. A method according to claim 18, further comprising identifying the information about at least one of the multilayer tubular structure and the products stored in the identification device using a reading device.

20. A method according to claim 16, wherein the embedding step includes integrally bonding a matrix of metallic particles and the fibers.

21. A method according to claim 16, wherein the embedding step includes dispersing a matrix of metallic particles substantially throughout the tubular body.

22. A method of manufacturing and using a multilayer tubular structure for supporting a product to be wrapped thereabout, the method comprising:

forming the tubular structure from a plurality of body layers that include an inner body layer and an outer body layer, the body layers having inner and outer surfaces and opposed ends;

embedding an identification device having an antenna and capacitor in the body layers such that the identification device is interposed between the inner and outer body layers, the identification device providing a unique identification for the tubular structure;

wrapping a product about the outer surface of the outer body layer;

storing information in the identification device about the product wrapped about the body layers; and identifying the stored information about the product stored in the identification device using a reader.

23. A method according to claim 22, further comprising:

deleting the stored information about the product, such that the identification device and tubular structure can be re-used in conjunction with another product.

24. A method for making a multilayered tubular structure, thc method comprising the steps of:

affixing a radio frequency identification device to a surface of a first ply of flexible material;

winding the first ply having the radio frequency identification device about a mandrel;

providing a second ply of flexible material having an opening therethrough, the opening being sized to accommodate the radio frequency identification device; and winding the second ply having the opening about the mantel in contact with the surface of the first ply in such a manner that the radio frequency identification device is positioned in the opening in the second ply, and adhering the first and second plies together to form a multilayered tubular structure.

25. The method of claim 24, wherein the second ply is wound about the mandrel prior to the first ply being wound about the mandrel.

26. The method of claim 24, further comprising the step of winding an innermost ply about the mandrel prior to winding the first and second plies.

27. A multilayered tubular structure, comprising:

a first ply of flexible material having a radio frequency identification device affixed to a surface of the first ply, the first ply being wound about an axis; and a second ply of flexible material having an opening therethrough, the second ply being wound about the axis and in contact with the surface of the first ply and adhered thereto by an adhesive to form said multilayered tubular structure, with the radio frequency identification device being positioned in the opening in the second ply.

28. The multilayered tubular structure of claim 27, further comprising a third ply wound about an axis against the second ply, on an opposite side of the second ply from the first ply, such that the third ply covers the opening in the second ply.

* * * * *

UNITED STATES PATENT AND TRADEMARK OFFICE

CERTIFICATE OF CORRECTION

PATENT NO. : 7,038,587 B2
APPLICATION NO. : 10/818379
DATED : May 2, 2006
INVENTOR(S) : Bellum et al.

It is certified that error appears in the above-identified patent and that said Letters Patent is hereby corrected as shown below:

Column 9,
Line 12, “the” should read --the--;
Line 22, “mantel” should read --mandrel--.

Signed and Sealed this

Twelfth Day of September, 2006

JON W. DUDAS
*Director of the United States Patent and Trademark Office*